US006810378B2

(12) United States Patent
Kochanski et al.

(10) Patent No.: US 6,810,378 B2
(45) Date of Patent: Oct. 26, 2004

(54) METHOD AND APPARATUS FOR CONTROLLING A SPEECH SYNTHESIS SYSTEM TO PROVIDE MULTIPLE STYLES OF SPEECH

(75) Inventors: Gregory P. Kochanski, Dunellen, NJ (US); Chi-Lin Shih, Berkeley Heights, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 542 days.

(21) Appl. No.: 09/961,923

(22) Filed: Sep. 24, 2001

(65) Prior Publication Data

US 2003/0078780 A1 Apr. 24, 2003

Related U.S. Application Data

(60) Provisional application No. 60/314,043, filed on Aug. 22, 2001.

(51) Int. Cl.[7] ..... G10L 13/02
(52) U.S. Cl. ..... 704/258; 704/260
(58) Field of Search ..... 704/260

(56) References Cited

U.S. PATENT DOCUMENTS 4,692,941 A * 9/1987 Jacks et al. ..... 704/260
5,615,300 A * 3/1997 Hara et al. ..... 704/260
5,860,064 A 1/1999 Henton ..... 704/260
6,185,533 B1 2/2001 Holm et al. ..... 704/260
6,260,016 B1 * 7/2001 Holm et al. ..... 704/260
6,594,631 B1 * 7/2003 Cho et al. ..... 704/268

FOREIGN PATENT DOCUMENTS

JP 411143483 * 5/1999 ..... G10L/3/00

OTHER PUBLICATIONS

U.S. patent application Ser. No. 09/711,563, Shih et al., filed Nov. 13, 2000.

U.S. patent application Ser. No. 09/845,561, Kochanski et al., filed Apr. 30, 2001.

"A Singing Voice Synthesis System Based on Sinusoidal Modeling", Macon, M.W., et al, Proceedings of International Conference on Acoustics, Speech, and Signal Processing, vol. 1, pp. 435–438, 1997.

(List continued on next page.)

*Primary Examiner*—Daniel Abebe
(74) *Attorney, Agent, or Firm*—Kenneth M. Brown

(57) ABSTRACT

A method and apparatus for synthesizing speech from text whereby the speech may be generated in a manner so as to effectively convey a particular, selectable style. Repeated patterns of one or more prosodic features—such as, for example, pitch, amplitude, spectral tilt, and/or duration—occurring at characteristic locations in the synthesized speech, are advantageously used to convey a particular chosen style. For example, one or more of such feature patterns may be used to define a particular speaking style, and an illustrative text-to-speech system then makes use of such a defined style to adjust the specified parameter or parameters of the synthesized speech in a non-uniform manner (i.e., in accordance with the defined feature pattern or patterns).

16 Claims, 7 Drawing Sheets

OTHER PUBLICATIONS

"Generating Pitch Accent Distributions That Show Individual and Stylistic Differences", Cahn, J.E.; Third ESCA/COCOSDA Workshop on Speech Synthesis, Jenolan Caves, Blue Mountains, Australia, Nov. 26–29, 1998.

"Speaking Styles: Statistical Analysis and Synthesis by a Text–to–Speech System" by M. Abe, Progress in Speech Synthesis , Jan P.H. van Santen, et al., editors, Springer–Verlag New York, Inc., pp. 495–511, 1996.

"Effect of Speaking Style on Parameters of Fundamental Frequency Contour" by N. Higuchi, et al., Progress in Speech Synthesis , Jan P.H. van Santen, et al., editors, Springer–Verlag New York, Inc., pp. 417–429, 1996.

"A Quantitative Model of $F_0$ Generation and Alignment" by Jan P.H. van Santen, et al., Intonation Analysis, Modelling and Technology, Antonis Botinis, editor, Kluwer Academic Publishers, Boston., pp. 269–287, 2000.

"Suprasegmental and segmental timing models in Mandarin Chinese and American English" by Jan P.H. van Santen, et al., J. Acoustical Society of America 107(2), pp. 1012–1026, Feb., 2000.

Sable: A Standard For TTS Markup, by R. Sproat, et al., The $5^{th}$ International Conference on Spoken Language Processing, Sydney Convention Centre, Sydney, Australia, 1998.

* cited by examiner

METHOD AND APPARATUS FOR CONTROLLING A SPEECH SYNTHESIS SYSTEM TO PROVIDE MULTIPLE STYLES OF SPEECH

CROSS-REFERENCE TO RELATED APPLICATION

The present application hereby claims the benefit of previously filed Provisional patent application Ser. No., 60/314,043, "Method and Apparatus for Controlling a Speech Synthesis System to Provide Multiple Styles of Speech," filed by G. P. Kochanski et al. on Aug. 22, 2001.

FIELD OF THE INVENTION

The present invention relates generally to the field of text-to-speech conversion (i.e., speech synthesis) and more particularly to a method and apparatus for capturing personal speaking styles and for driving a text-to-speech system so as to convey such specific speaking styles.

BACKGROUND OF THE INVENTION

Although current state-of-the-art text-to-speech conversion systems are capable of providing reasonably high quality and close to human-like sounding speech, they typically train the prosody attributes of the speech based on data from a specific speaker. In certain text-to-speech applications, however, it would be highly desirable to be able to capture a particular style, such as, for example, the style of a specifically identifiable person or of a particular class of people (e.g., a southern accent).

While the value of a style is subjective and involves personal, social and cultural preferences, the existence of style itself is objective and implies that there is a set of consistent features. These features, especially those of a distinctive, recognizable style, lend themselves to quantitative studies and modeling. A human impressionist, for example, can deliver a stunning performance by dramatizing the most salient feature of an intended style. Similarly, at least in theory, it should be possible for a text-to-speech system to successfully convey the impression of a style when a few distinctive prosodic features are properly modeled. However, to date, no such text-to-speech system has been able to achieve such a result in a flexible way.

SUMMARY OF THE INVENTION

In accordance with the present invention, a novel method and apparatus for synthesizing speech from text is provided, whereby the speech may be generated in a manner so as to effectively convey a particular, selectable style. In particular, repeated patterns of one or more prosodic features—such as, for example, pitch (also referred to herein as "$f_0$", the fundamental frequency of the speech waveform, since pitch is merely the perceptual effect of $f_0$), amplitude, spectral tilt, and/or duration—occurring at characteristic locations in the synthesized speech, are advantageously used to convey a particular chosen style. In accordance with one illustrative embodiment of the present invention, for example, one or more of such feature patterns may be used to define a particular speaking style, and an illustrative text-to-speech system then makes use of such a defined style to adjust the specified parameter or parameters of the synthesized speech in a non-uniform manner (i.e., in accordance with the defined feature pattern or patterns).

More specifically, the present invention provides a method and apparatus for synthesizing a voice signal based on a predetermined voice control information stream (which, illustratively, may comprise text, annotated text, or a musical score), where the voice signal is selectively synthesized to have a particular desired prosodic style. In particular, the method and apparatus of the present invention comprises steps or means for analyzing the predetermined voice control information stream to identify one or more portions thereof for prosody control; selecting one or more prosody control templates based on the particular prosodic style which has been selected for the voice signal synthesis; applying the one or more selected prosody control templates to the one or more identified portions of the predetermined voice control information stream, thereby generating a stylized voice control information stream; and synthesizing the voice signal based on this stylized voice control information stream so that the synthesized voice signal advantageously has the particular desired prosodic style.

DETAILED DESCRIPTION

Overview

Figure 1:
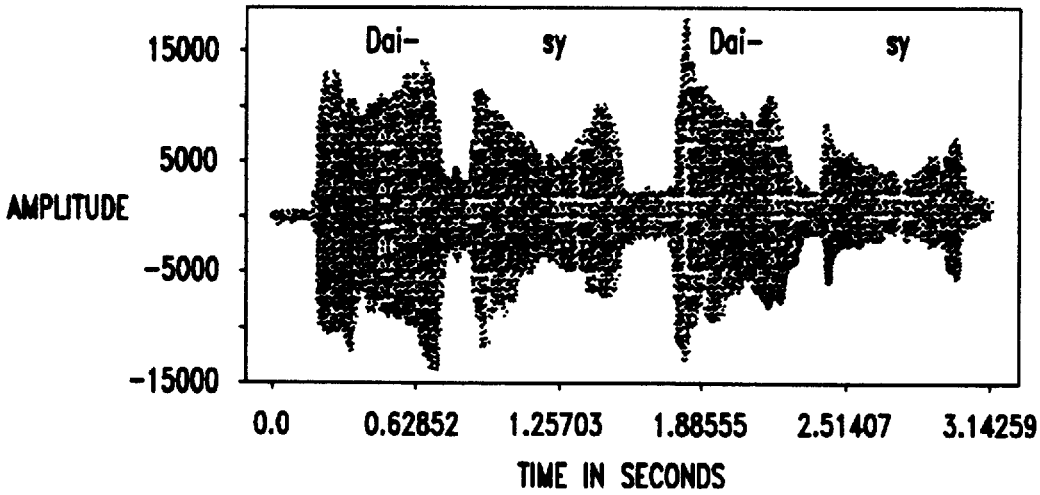
FIG. 1 shows the amplitude profiles of the first four syllables "Dai-sy Dai-sy" from the song "Bicycle built for two" as sung by the singer Dinah Shore.

In accordance with one illustrative embodiment of the present invention, a personal style for speech may be advantageously conveyed by repeated patterns of one or more features such as pitch, amplitude, spectral tilt, and/or duration, occurring at certain characteristic locations. These locations reflect the organization of speech materials. For example, a speaker may tend to use the same feature patterns at the end of each phrase, at the beginning, at emphasized words, or for terms newly introduced into a discussion.

Recognizing a particular style involves several cognitive processes:

(1) Establish what the norm is based on past experiences and expectations.

(2) Compare a sample to the norm and identify attributes that are most distinct from the norm.

(3) Establish a hypothesis on where these attributes occur. For example, given the description that a person "swallows his words at the end of the sentence", the describer recognizes both the attribute, "swallows his words", and the location where this attribute occurs, "at the end of the sentence". Thus, an impressionist who imitates other people's speaking styles needs to master an additional generation process, namely:

(4) Build a production model of the identified attributes and apply them where it is appropriate.

Therefore, in accordance with an illustrative embodiment of the present invention, a computer model may be built to mimic a particular style by advantageously including processes that simulate each of the steps above with precise instructions at every step:

(1) Establish the "norm" from a set of databases. This step involves the analysis of attributes that are likely to be used to distinguish styles, which may include, but are not necessarily restricted to, $f_0$, amplitude, spectral tilt, and duration. These properties may be advantageously associated with linguistic units (e.g., phonemes, syllables, words, phrases, paragraphs, etc.), locations (e.g., the beginning or the end of a linguistic unit), and prosodic entities (e.g., strong vs. weak units).

(2) Learning the style of a speech sample. This step may include, first, the comparisons of the attributes from the sample with those of a representative database, and second, the establishment of a distance measure in order to decide which attributes are most salient to a given style.

(3) Learning the association of salient attributes and the locales of their occurrences. In the above example, an impressionistic conclusion that words are swallowed at the end of every sentence is most likely an over generalization. Sentence length and discourse functions are factors that potentially play a role in determining the occurrence of this phenomenon.

(4) Analyzing data to come up with quantitative models of the attributes, so that the effect can be generated automatically. Examples include detailed models of accent shapes or amplitude profiles.

In the description which follows, we use examples from both singing and speech to illustrate the concept of styles, and then describe the modeling of these features in accordance with an illustrative embodiment of the present invention.

ILLUSTRATIVE EXAMPLES OF STYLES

FIG. 1 shows the amplitude profiles of the first four syllables "Dai-sy Dai-sy" from the song "Bicycle built for two," written and composed by Harry Dacre, as sung by the singer Dinah Shore, who was described as a "rhythmical singer". (See, "Bicycle Built for Two". Dinah Shore, in The Dinah Shore Collection, Columbia and RCA recordings, 1942–1948.) Note that a bow-tie-shaped amplitude profile expands over each of the four syllables, or notes. The second syllable, centered around 1.2 second, gives the clearest example. The increasing amplitude of the second wedge creates a strong beat on the third, presumably weak beat of a ¾ measure. This style of amplitude profile shows up very frequently in Dinah Shore's singing. The clash with the listeners expectation and the consistent delivery mark a very distinct style.

Figure 2:
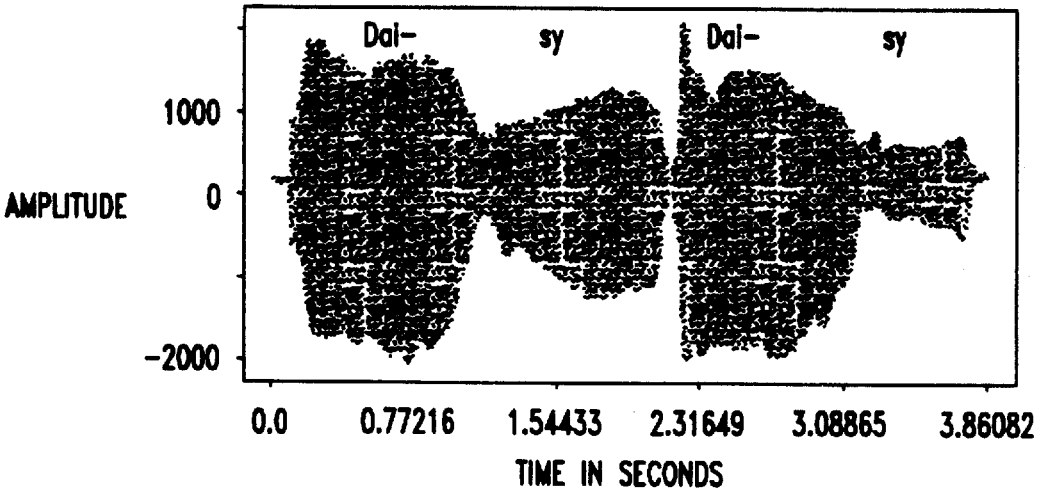
FIG. 2 shows the amplitude profile of the same four syllables "Dai-sy Dai-sy" from an amateur singer.

In contrast, FIG. 2 shows the amplitude profile of the same four syllables "Dai-sy Dai-sy" from an amateur singer. We can see more typical characteristics of amplitude profile in this plot. For example, amplitude tends to drop off at the end of a syllable and at the end of the phrase, and it also reflects the phone composition of the syllable.

Figure 3:
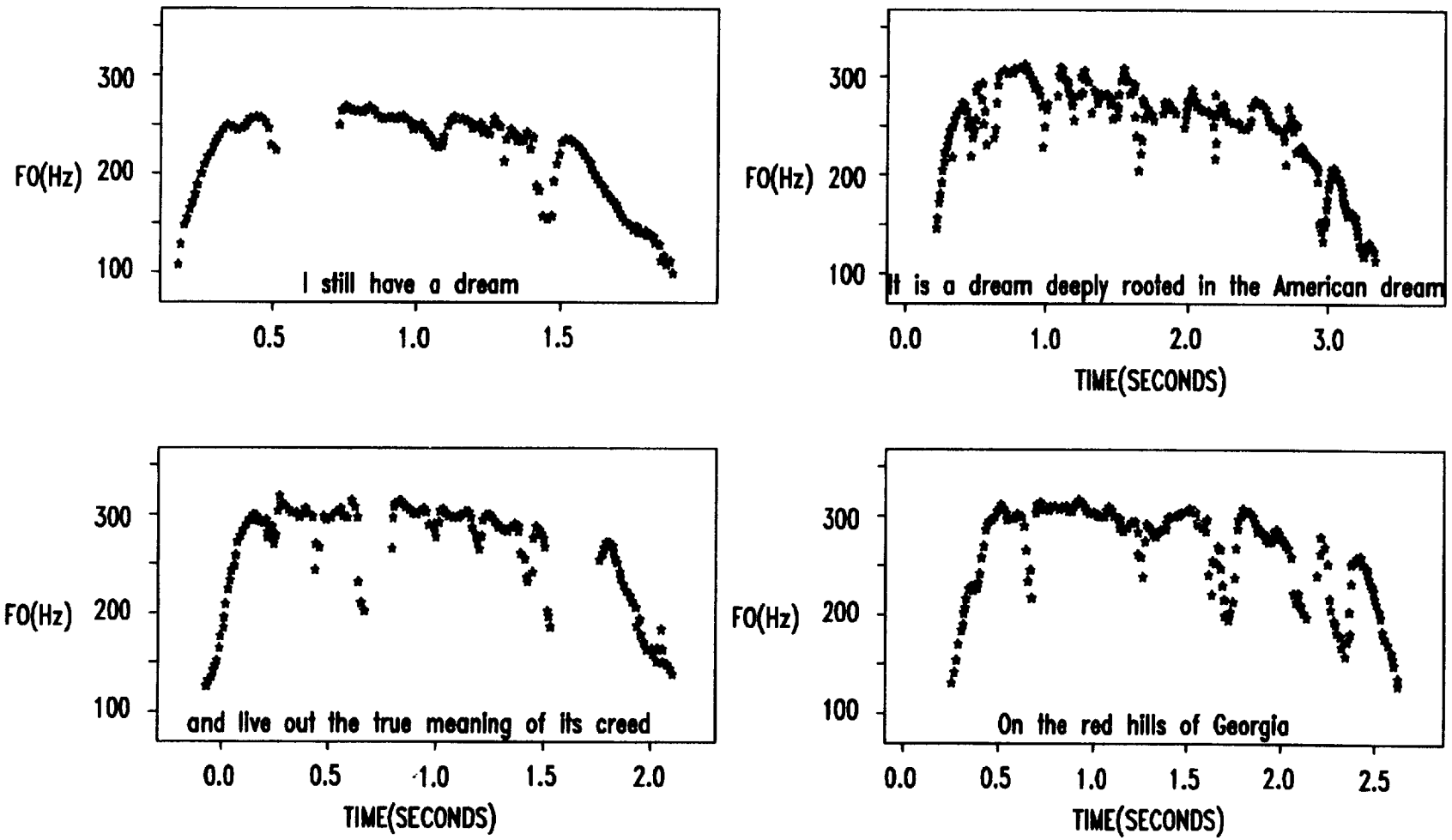
FIG. 3 shows the $f_0$ trace over four phrases from the speech "I have a dream" as delivered by Dr. Martin Luther King, Jr.

FIG. 3 shows the $f_0$ trace over four phrases from the speech "I have a dream" as delivered by Dr. Martin Luther King Jr. Consistently, a dramatic pitch rise marks the beginning of the phrase and an equally dramatic pitch fall marks the end. The middle section of the phrases are sustained on a high pitch level. Note that pitch profiles similar to those shown in FIG. 3 marked most phrases found in Martin Luther King's speeches, even though the phrases differ in textual content, syntactic structure, and phrase length.

Figure 4:
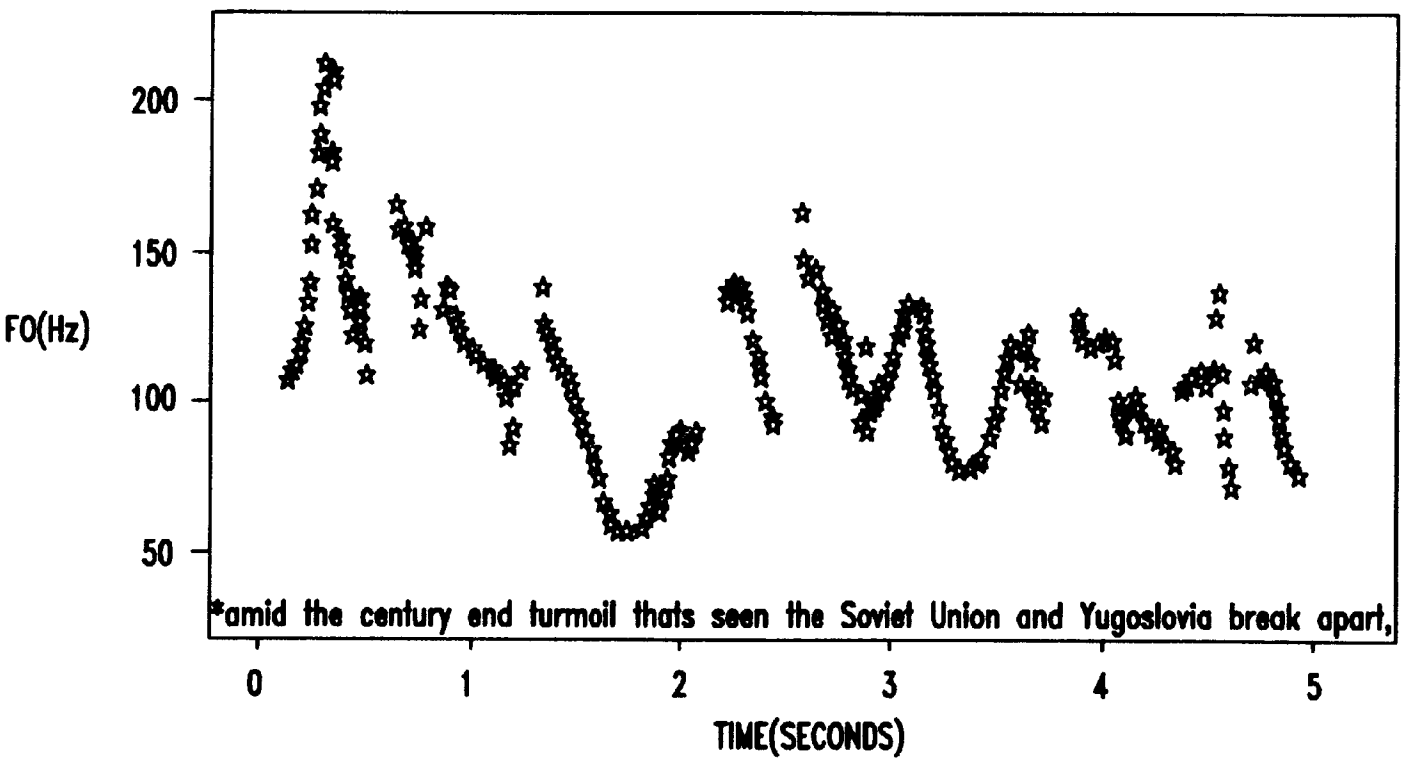
FIG. 4 shows the $f_0$ trace of a sentence as delivered by a professional speaker in the news broadcasting style.

FIG. 4 shows, as a contrasting case to that of FIG. 3, the $f_0$ trace of a sentence as delivered by a professional speaker in the news broadcasting style. In FIG. 4, the dominant $f_0$ change reflects word accent and emphasis. The beginning of the phrase is marked by a pitch drop, the reverse of the pitch rise in King's speech. Note that word accent and emphasis modifications are present in King's speech, but the magnitude of the change is relatively small compared to the $f_0$ change marking the phrase. The $f_0$ profile over the phrase is one of the most important attributes marking King's distinctive rhetorical style.

An Illustrative Text-to-speech System in Accordance with the Present Invention

Figure 5:
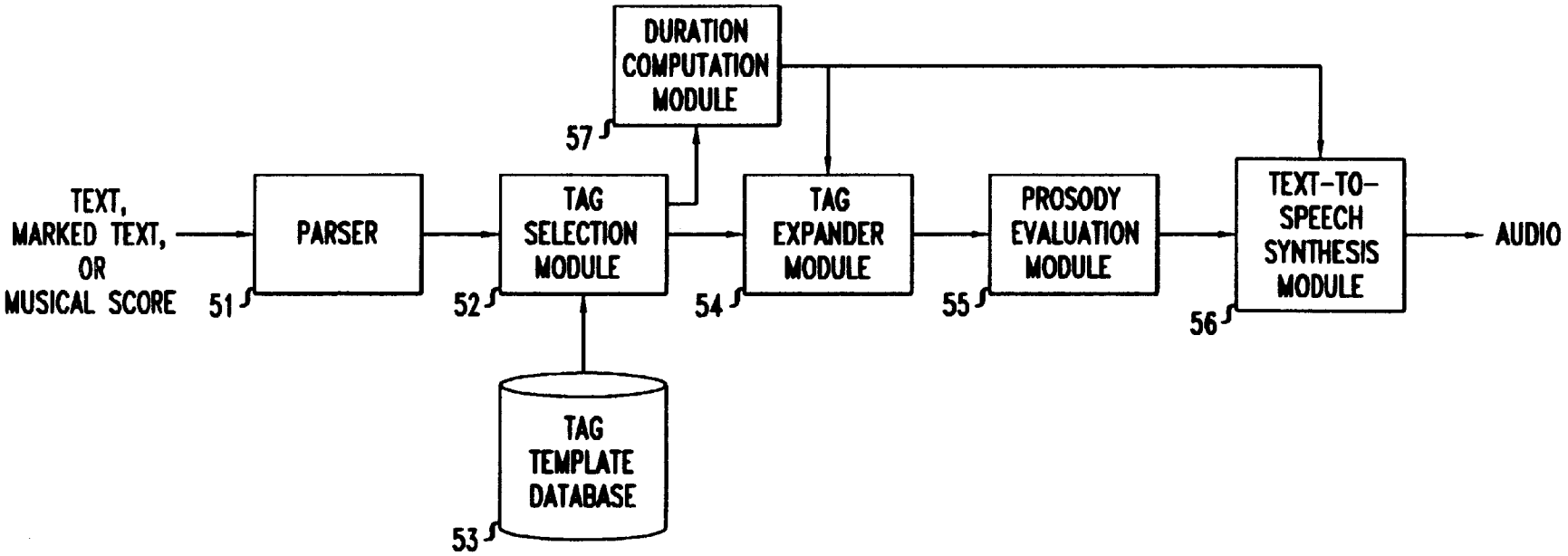
FIG. 5 shows a text-to-speech system for providing multiple styles of speech in accordance with an illustrative embodiment of the present invention.

FIG. 5 shows a text-to-speech system for providing multiple styles of speech in accordance with an illustrative embodiment of the present invention. The illustrative implementation consists of 4 key modules in addition to an otherwise conventional text-to-speech system which is controlled thereby. The first key module is parser 51, which extracts relevant features from an input stream, which input stream will be referred to herein as a "voice control information stream." In accordance with some illustrative embodiments of the present invention, that stream may consist, for example, of words to be spoken, along with optional mark-up information that specifies some general aspects of prosody. Alternately, in accordance with other illustrative embodiments of the present invention, the stream may consist of a musical score.

One set of examples of such features to be extracted by parser 51 are HTML mark-up information (e.g., boldface regions, quoted regions, italicized regions, paragraphs, etc.), which are fully familiar to those skilled in the art. Another set of examples derive from a possible syntactic parsing of the text into noun phrases, verb phrases, primary and subordinate clauses. Other mark-up information may be in the style of SABLE, which is familiar to those skilled in the art, and is described, for example, in "SABLE: A Standard for TTS Markup," by R. Sproat et al., Proc. Int'l. Conf. On Spoken Language Processing 98, pp. 1719–1724, Sydney, Australia, 1998. By way of example, a sentence may be marked as a question, or a word may be marked as important or marked as uncertain and therefore in need of confirmation.

In any event, the resulting features are passed to tag selection module 52, which decides which tag template should be applied to what point in the voice stream. Tag selection module 52 may, for example, consult tag template database 53, which advantageously contains tag templates for various styles, selecting the appropriate template for the particular desired voice. The operation of tag selection module 52 may also be dependant on parameters or subroutines which it may have loaded from tag template database 53.

Next, the tag templates are expanded into tags in tag expander module 54. The tag expander module advantageously uses information about the duration of appropriate units of the output voice stream, so that it knows how long (e.g., in seconds) a given syllable, word or phrase will be after it has been synthesized by the text-to-speech conversion module), and at what point in time the given syllable, word or phrase will occur. In accordance with one illustrative embodiment of the present invention, tag expander module 54 merely inserts appropriate time information into the tags, so that the prosody will be advantageously synchronized with the phoneme sequence. Other illustrative embodiments of the present invention may actively calculate appropriate alignments between the tags and the phonemes, as is known in the art and described, for example, in "A Quantitative Model of F0 Generation and Alignment," by J. van Santen et al., in Intonation: Analysis, Modelling and Technology, A. Botinis ed., Kluwar Academic Publishers, 2000.

Next, prosody evaluation module 55 converts the tags into a time series of prosodic features (or the equivalent) which can be used to directly control the synthesizer. The result of prosody evaluation module 55 may be referred to as a "stylized voice control information stream," since it provides voice control information adjusted for a particular style. And finally, text-to-speech synthesis module 56 generates the voice (e.g., speech or song) waveform, based on the marked-up text and the time series of prosodic features or equivalent (i.e., based on the stylized voice control information stream). As pointed out above, other than its ability to incorporate this time series of prosodic features, text-to-speech synthesis module 56 may be fully conventional.

In accordance with one illustrative embodiment of the present invention, the synthesis system of the present invention also advantageously controls the duration of phonemes, and therefore also includes duration computation module 57, which takes input from parser module 51 and/or tag selection module 52, and calculates phoneme durations that are fed to the synthesizer (text-to-speech synthesis module 56) and to tag expander module 54.

As explained above, the output of the illustrative prosody evaluation module 55 of the illustrative text-to-speech system of FIG. 5 includes a time series of features (or, alternatively, a suitable transformation of such features), that will then be used to control the final synthesis step of the synthesis system (i.e., text-to-speech synthesis module 56). By way of example, the output might be a series of 3-tuples at 10 millisecond intervals, wherein the first element of each tuple might specify the pitch of the synthesized waveform; the second element of each tuple might specify the amplitude of the output waveform (e.g., relative to a reference amplitude); and the third component might specify the spectral tilt (i.e., the relative amount of power at low and high frequencies in the output waveform, again, for example, relative to a reference value). (Note that the reference amplitude and spectral tilt may advantageously be the default values as would normally be produced by the synthesis system, assuming that it produces relatively uninflected, plain speech.)

In accordance with the illustrative embodiment of the present invention shown in FIG. 5, text-to-speech synthesis module 56 advantageously applies the various features as provided by prosody evaluation module 55 only as appropriate to the particular phoneme being produced at a given time. For example, the generation of speech for an unvoiced phoneme would advantageously ignore a pitch specification, and spectral tilt information might be applied differently to voiced and unvoiced phonemes. In some embodiments of the present invention, text-to-speech synthesis module 56 may not directly provide for explicit control of prosodic features other than pitch. In some of these embodiments, amplitude control may be advantageously obtained by multiplying the output of the synthesis module by an appropriate time-varying factor.

Another Illustrative Text-to-speech System in Accordance with the Present Invention In accordance with other illustrative embodiments of the present invention, prosody evaluation module 55 of FIG. 5 may be omitted, if text-to-speech synthesis module 56 is provided with the ability to evaluate the tags directly. This may be advantageous if the system is based on a "large database" text-to-speech synthesis system, familiar to those skilled in the art.

In such an implementation of a text-to-speech synthesizer, the system stores a large database of speech samples, typically consisting of many copies of each phoneme, and often, many copies of sequences of phonemes, often in context. For example, the database in such a text-to-speech synthesis module might include (among many others) the utterances "I gave at the office," "I bake a cake" and "Baking chocolate is not sweetened," in order to provide numerous examples of dipthong "a" phoneme. Such a system typically operates by selecting sections of the utterances in its database in such a manner as to minimize a cost measure which may, for example, be a summation over the entire synthesized utterance. Commonly, the cost measure consists of two components—a part which represents the cost of the perceived discontinuities introduced by concatenating segments together, and a part which represents the mismatch between the desired speech and the available segments.

In accordance with such an illustrative embodiment of the present invention, the speech segments stored in the database of text-to-speech synthesis module 56 would be advantageously tagged with prosodic labels. Such labels may or may not correspond to the labels described above as produced by tag expander module 54. In particular, the operation of text-to-speech module 56 would advantageously include an evaluation of a cost measure based (at least in part) on the mismatch between the desired label (as produced by tag expander module 54) and the available labels attached to the segments contained in the database of text-to-speech synthesis module 56.

Tag Templates

In accordance with certain illustrative embodiments of the present invention, the illustrative text-to-speech conversion system operates by having a database of "tag templates" for each style. "Tags." which are familiar to those skilled in the art, are described in detail, for example, in co-pending U.S. patent application Ser. No. 09/845,561, "Methods and Apparatus for Text to Speech Processing Using Language Independent Prosody Markup," by Kochanski et al., filed on Apr. 30, 2001, and commonly assigned to the assignee of the present invention. U.S. patent application Ser. No. 09/845, 561 is hereby incorporated by reference as if fully set forth herein.

In accordance with the illustrative embodiment of the present invention, these tag templates characterize different prosodic effects, but are intended to be independent of speaking rate and pitch. Tag templates are converted to tags by simple operations such as scaling in amplitude (i.e., making the prosodic effect larger), or by stretching the generated waveform along the time axis to match a particular scope. For example, a tag template might be stretched to the length of a syllable, if that were its defined scope (i.e., position and size), and it could be stretched more for longer syllables.

In accordance with certain illustrative embodiments of the present invention, similar simple transformations, such as, for example, nonlinear stretching of tags, or lengthening tags by repetition, may also be advantageously employed. Likewise, tags may be advantageously created from templates by having three-section templates (i.e., a beginning, a middle, and an end), and by concatenating the beginning, a number, N, of repetitions of the middle, and then the end.

While one illustrative embodiment of the present invention has tag templates that are a segment of a time series of the prosodic features (possibly along with some additional parameters as will be described below), other illustrative embodiments of the present invention may use executable subroutines as tag templates. Such subroutines might for example be passed arguments describing their scope—most typically the length of the scope and some measure of the linguistic strength of the resulting tag. And one such illustrative embodiment may use executable tag templates for special purposes, such as, for example, for describing vibrato in certain singing styles.

In addition, in accordance with certain illustrative embodiments of the present invention, the techniques described in U.S. patent application Ser. No. 09/845,561 whereby tags may be expressed not directly in terms of the output prosodic features (such as amplitude, pitch, and spectral tilt), but rather are expressed as approximations of psychological terms, such as, for example, emphasis and suspicion. In such embodiments, the prosody evaluation module may be used to transform the approximations of psychological features into actual prosodic features. It may be advantageously assumed, for example, that a linear, matrix transformation exists between the approximate psychological and the prosodic features, as is also described in U.S. patent application Ser. No. 09/845,561.

Note in particular that the number of the approximate psychological features in such a case need not equal the number of prosodic features that the text-to-speech system can control. In fact, in accordance with one illustrative embodiment of the present invention, a single approximate psychological feature—namely, emphasis—is used to control, via a matrix multiplication, pitch, amplitude, spectral tilt, and duration.

Prosody Tags

In accordance with certain illustrative embodiments of the present invention, each tag advantageously has a scope, and it substantially effects the prosodic features inside its scope, but has a decreasing effect as one goes farther outside its scope. In other words, the effects of the tags are more or less local. Typically, such a tag would have a scope the size of a syllable, a word, or a phrase. As a reference implementation and description of one suitable set of tags for use in the prosody control of speech and song in accordance with one illustrative embodiment of the present invention, see, for example, U.S. patent application Ser. No. 09/845,561, which has been heretofore incorporated by reference herein. The particular tagging system described in U.S. patent application Ser. No. 09/845,561 and which will be employed in the present application for illustrative purposes is referred to herein as "Stem-ML" (Soft TEMplate Mark-up Language). In particular and advantageously, Stem-ML is a tagging system with a mathematically defined algorithm to translate tags into quantitative prosody. The system is advantageously designed to be language independent, and furthermore, it can be used effectively for both speech and music.

Following the illustrative embodiment of the present invention as shown in FIG. 5, text or music scores are passed to the tag generation process (comprising, for example, tag selection module 52, duration computation module 57, and tag expander module 54), which uses heuristic rules to select and to position prosodic tags. Style-specific information is read in (for example, from tag template database 53) to facilitate the generation of tags. Note that in accordance with various illustrative embodiments of the present invention, style-specific attributes may include parameters controlling, for example, breathing, vibrato, and note duration for songs, in addition to Stem-ML templates to modify $f_0$ and amplitude, as for speech. The tags are then sent to the prosody evaluation module 55, which actually comprises the Stem-ML "algorithm", and which actually produces a time series of $f_0$ or amplitude values.

We advantageously rely heavily on two of the Stem-ML features to describe speaker styles in accordance with one illustrative embodiment of the present invention. First, note that Stem-ML allows the separation of local (accent templates) and non-local (phrasal) components of intonation. One of the phrase level tags, referred to herein as step_to, advantageously moves $f_0$ to a specified value which remains effective until the next step_to tag is encountered. When described by a sequence of step_to tags, the phrase curve is essentially treated as a piece-wise differentiable function. (This method is illustratively used below to describe Martin Luther King's phrase curve and Dinah Shore's music notes.) Secondly, note that Stem-ML advantageously accepts user-defined accent templates with no shape and scope restrictions. This feature gives users the freedom to write templates to describe accent shapes of different languages as well as variations within the same language. Thus, we are able to advantageously write speaker-specific accent templates for speech, and ornament templates for music.

The specified accent and ornament templates as described above may result in physiologically implausible combination of targets. However, Stem-ML advantageously accepts conflicting specifications and returns smooth surface realizations that best satisfy all constraints.

Note that the muscle motions that control prosody are smooth because it takes time to make the transition from one intended accent target to the next. Also note that when a section of speech material is unimportant, a speaker may not expend much effort to realize the targets. Therefore, the surface realization of prosody may be advantageously realized as an optimization problem, minimizing the sum of two functions—a physiological constraint G, which imposes a smoothness constraint by minimizing the first and second derivatives of the specified pitch p, and a communication constraint R, which minimizes the sum of errors r between the realized pitch p and the targets y.

The errors may be advantageously weighted by the strength $S_1$ of the tag which indicates how important it is to satisfy the specifications of the tag. If the strength of a tag is weak, the physiological constraint takes over and in those cases, smoothness becomes more important than accuracy. The strength $S_1$ controls the interaction of accent tags with their neighbors by way of the smoothness requirement, G—stronger tags exert more influence on their neighbors. Tags may also have parameters $\alpha$ and $\beta$, which advantageously control whether errors in the shape or average value of $p_1$ is most important—these are derived from the Stem-ML type parameter. In accordance with the illustrative embodiment of the present invention described herein, the targets, y, advantageously consist of an accent component riding on top of a phrase curve.

Specifically, for example, the following illustrative equations may be employed:

$$G = \sum_t \dot{p}_t^2 + (\pi\tau/2)^2 \ddot{p}_t^2 \quad (1)$$

$$R = \sum_{i \in tags} S_i^2 r_i \quad (2)$$

$$r_i = \sum_{t \in tagi} \alpha(p_t - y_t)^2 + \beta(\bar{p} - \bar{y})^2 \quad (3)$$

Then, the resultant generated $f_0$ and amplitude contours are used by one illustrative text-to-speech system in accordance with the present invention to generate stylized speech and/or songs. In addition, amplitude modulation may be advantageously applied to the output of the text-to-speech system.

Note that the tags described herein are normally soft constraints on a region of prosody, forcing a given scope to have a particular shape or a particular value of the prosodic features. In accordance with one illustrative embodiment, tags may overlap, and may also be sparse (i.e., there can be gaps between the tags).

In accordance with one illustrative embodiment of the present invention, several other parameters are passed along with the tag template to the tag expander module. One of these parameters controls how the strength of the tag scales with the length of the tag's scope. Another one of these parameters controls how the amplitude of the tag scales with the length of the scope. Two additional parameters show how the length and position of the tag depend on the length of the tag's scope. Note that it does not need to be assumed that the tag is bounded by the scope, or that the tag entirely fills the scope. While tags will typically approximately match their scope, it is completely normal for the length of a tag to range from 30% to 130% of the length of it's scope, and it is completely normal for the center of the tag to be offset by plus or minus 50% of the length of it's scope.

In accordance with one illustrative embodiment of the present invention, a voice can be defined by as little as a single tag template, which might, for example, be used to mark accented syllables in the English language. More commonly, however, a voice would be advantageously specified by approximately 2–10 tag templates.

Prosody Evaluation

In accordance with illustrative embodiments of the present invention, after one or more tags are generated they are fed into a prosody evaluation module such as prosody evaluation module 55 of FIG. 5. This module advantageously produces the final time series of features. In accordance with one illustrative embodiment of the present invention, for example, the prosody evaluation unit explicitly described in U.S. patent application Ser. No. 09/845,561 may be advantageously employed. Specifically, and as described above, the method and apparatus described therein advantageously allows for a specification of the linguistic strength of a tag, and handles overlapping tags by compromising between any conflicting requirements. It also interpolates to fill gaps between tags.

In accordance with another illustrative embodiment of the present invention, the prosody evaluation unit comprises a simple concatenation operation (assuming that the tags are non-sparse and non-overlapping). And in accordance with yet another illustrative embodiment of the present invention, the prosody evaluation unit comprises such a concatenation operation with linear interpolation to fill any gaps.

Tag Selection

In accordance with principles of the present invention as illustratively shown in FIG. 5, tag selection module 52 advantageously selects which of a given voice's tag templates to use at each syllable. In accordance with one illustrative embodiment of the present invention, this subsystem consists of a classification and regression (CART) tree trained on human-classified data. CART trees are familiar to those skilled in the art and are described, for example, in Breiman et al., Classification and Regression Trees, Wadsworth and Brooks, Monterey, Calif., 1984. In accordance with various illustrative embodiments of the present invention, tags may be advantageously selected at each syllable, each phoneme, or each word.

In accordance with the above-described CART tree-based illustrative embodiment, the CART may be advantageously fed a feature vector composed, for example, of some or all of the following information:

(1) information derived from a lexicon, such as, for example,
  (a) a marked accent type and strength derived from a dictionary or other parsing procedures,
  (b) information on whether the syllable is followed or preceded by an accented syllable, and/or
  (c) whether the syllable is the first or last in a word;
(2) information derived from a parser such as, for example,
  (a) whether the word containing the syllable terminates a phrase or other significant unit of the parse,
  (b) whether the word containing the syllable begins a phrase or other significant unit of the parse,
  (c) an estimate of how important the word is to understanding the text, and/or
  (d) whether the word is the first occurrence of a new term; and/or
(3) other information, such as, for example,
  (a) whether the word rhymes,
  (b) whether the word is within a region with a uniform metrical pattern (e.g., whether the surrounding words have accents { as derived from the lexicon} that have an iambic rhythm), and/or
  (c) if these prosodic tags are used to generate a song, whether the metrical pattern of the notes implies an accent at the given syllable.

In accordance with certain illustrative embodiments of the present invention, the system may be trained, as is well known in the art and as is customary, by feeding to the system an assorted set of feature vectors together with "correct answers" as derived from a human analysis thereof.

Duration Computation

As pointed out above in connection with the description of FIG. 5, in accordance with one illustrative embodiment of the present invention, the speech synthesis system of the present invention includes duration computation module 57 for control of the duration of phonemes. This module may, for example, perform in accordance with that which is described in co-pending U.S. patent application Ser. No. 09/711,563, "Methods And Apparatus For Speaker Specific Durational Adaptation," by Shih et al. filed on Nov. 13, 2000. and commonly assigned to the assignee of the present invention, which application is hereby incorporated by reference as if fully set forth herein.

Specifically, in accordance, with one illustrative embodiment of the present invention, tag templates are advantageously used to perturb the duration of syllables. First, a duration model is built that will produce plain, uninflected speech. Such models are well known to those skilled in the art. Then, a model is defined for perturbing the durations of phonemes in a particular scope. Note that duration models whose result is dependent on a binary stressed vs. unstressed decision are well known. (See. e.g., "Suprasegmental and segmental timing models in Mandarin Chinese and American English," by van Santen et al., Journal of Acoustical Society of America, 107(2), 2000.)

AN ILLUSTRATIVE EXAMPLE OF INCORPORATING STYLE ACCORDING TO THE PRESENT INVENTION

We first turn to the aforementioned speech by Dr. Martin Luther King. Note that the speech has a strong phrasal component with an outline defined by an initial rise, optional stepping up to climax, and a final fall. This outline may be advantageously described with Stem-ML step_to tags, as described above. The argument "to", as indicated by the appearance of "to=" in each line below, specifies the intended $f_0$ as base+to x range, where base is the baseline and range is the speaker's pitch range.

Heuristic grammar rules are advantageously used to place the tags. Each phrase starts from the base value (to=0), stepping up on the first stressed word, remaining high until the end for continuation phrases, and stepping down on the last word of the final phrase. Then, at every pause, it returns to 20% of the pitch range above base (to=0.2), and then stepping up again on the first stressed word of the new phrase. Note that the amount of step_to advantageously correlates with the sentence length. Additional stepping up is advantageously used on annotated, strongly emphasized words.

Figure 6:
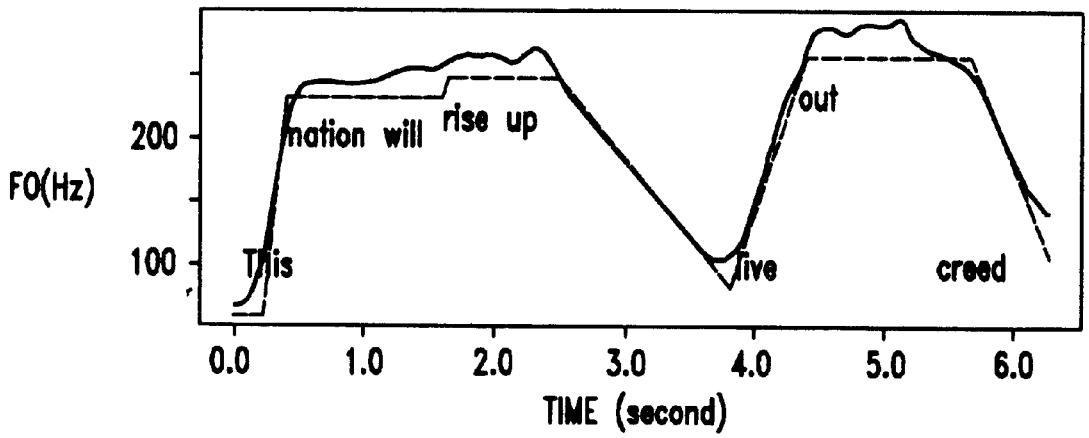
FIG. 6 shows an illustrative example of a generated phrase curve with accents in the style of Dr. Martin Luther King Jr. in accordance with an illustrative embodiment of the present invention.

Specifically, the following sequence of step_to tags may be used in accordance with one illustrative embodiment of the present invention to produce the phrase curve shown in the dotted lines in FIG. 6 for the sentence "This nation will rise up, and live out the true meaning of its creed," in the style of Dr. Martin Luther King, Jr. The solid line in the figure shows the generated $f_0$ curve, which is the combination of the phrase curve and the accent templates, as will be described below. (See "Accent template examples" section below). Note that lines interspersed in the following tag sequence which begin with the symbol "#" are commentary.

Cname=step-to; pos=0.21; strength=5; to=0;
Step up on the first stressed word "nation"
Cname=step-to; pos=0.42; strength=5; to=1.7;
Cname=step-to; pos=1.60; strength=5; to=1.7;
Further step up on rise
Cname=step-to; pos=1.62; strength=5; to=1.85;
Cname=step-to; pos=2.46; strength=5; to=1.85;
Beginning of the second phrase
Cname=step-to; pos=3.8; strength=5; to=0.2;
Step up on the first stress word live
Cname=step-to; pos=4.4; strength=5; to=2.0;
Cname=step-to; pos=5.67; strength=5; to=2.0;
Step down at the end of the phrase
Cname=step-to; pos=6.28; strength=5; to=0.4;

AN ILLUSTRATIVE EXAMPLE OF INCORPORATING STYLE IN SONG

Musical scores are in fact, under-specified. Thus, different performers may have very different renditions based on the same score. In accordance with one illustrative embodiment of the present invention, we make use of the musical structures and phrasing notation to insert ornaments and to implement performance rules, which include the default rhythmic pattern, retard, and duration adjustment.

An example of the musical input format in accordance with this illustrative embodiment of the present invention is given below, showing the first phrase of the song "Bicycle Built for Two." This information advantageously specifies notes and octave (columns 1), nominal duration (column 2), and text (column 3, expressed phonetically). Column 3 also contains accent information from the lexicon (strong accents are marked with double quotes, weak accents by periods). The letter "t" in the note column indicates tied notes, and a dash links syllables within a word. Percent signs mark phrase boundaries. Lines containing asterisks (*) mark measure boundaries, and therefore carry information on the metrical pattern of the song.

```
3/4         b = 260
%
g2          3           "dA-
**********************************
e2          3.0         zE
**********************************
%
c2          3           "dA-
**********************************
g1          3.0         zE
**********************************
%
**********************************
a1          1.00        "giv
b1          1.00        mE
c2          1.00        yUr
**********************************
a1          2.00        "an-
c2          1.00        sR
**********************************
g1t         3.0         "dU-
**********************************
g1          2.0
g1          1.0         *
%
```

In accordance with the illustrative embodiment of the present invention, musical notes may be treated analogously to the phrase curve in speech. Both are advantageously built with Stem-ML step_to tags. In music, the pitch range is defined as an octave, and each step is 1/12 of an octave in the logarithmic scale. Each musical note is controlled by a pair of step_to tags. For example, the first four notes of "Bicycle Built for Two" may, in accordance with this illustrative embodiment of the present invention, be specified as shown below:

Dai-(Note G)
Cname=step-to; pos=0.16; strength=8; to=1.9966;
Cname=step-to; pos=0.83; strength=8; to=1.9966;
# sy (Note E)
Cname=step-to; pos=0.85; strength=8; to=1.5198;
Cname=step-to; pos=1.67; strength=8; to=1.5198;
Dai-(Note C)
Cname=step-to; pos=1.69; strength=8; to=1.0000;
Cname=step-to; pos=2.36; strength=8; to=1.0000;
# sy (Note G, one octave lower)
Cname=step-to; pos=2.38; strength=8; to=0.4983;
Cname=step-to; pos=3.20; strength=8; to=0.4983;

Note that the strength specification of the musical step_to is very strong (i.e., strength=8). This helps to maintain the specified frequency as the tags pass through the prosody evaluation component.

Accent Template Examples

Word accents in speech and ornament notes in singing are described in style-specific tag templates. Each tag has a scope, and while it can strongly affect the prosodic features inside its scope, it has a decreasing effect as one goes farther outside its scope. In other words, the effects of the tags are more or less local. These templates are intended to be independent of speaking rate and pitch. They can be scaled in amplitude, or stretched along the time axis to match a particular scope. Distinctive speaking styles may be conveyed by idiosyncratic shapes for a given accent type.

Figure 7:
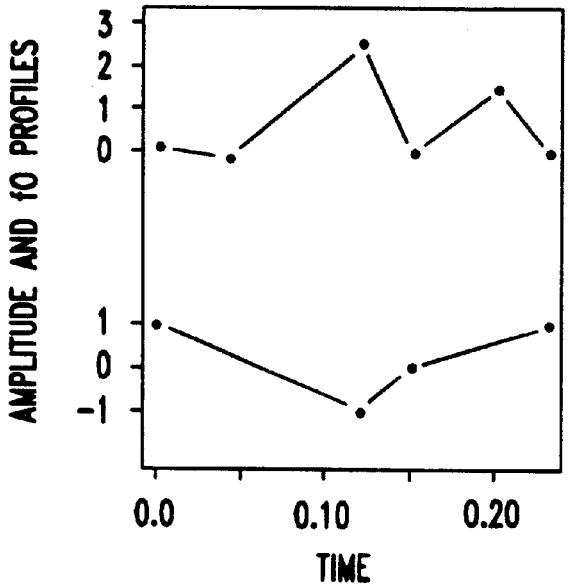
FIG. 7 shows the $f_0$ and amplitude templates of an illustrative ornament in the singing style of Dinah Shore for use with one illustrative embodiment of the present invention.

In the case of synthesizing style for a song, in accordance with one illustrative embodiment of the present invention templates of ornament notes may be advantageously placed in specified locations, superimposed on the musical note. FIG. 7 shows the $f_0$ (top line) and amplitude (bottom line) templates of an illustrative ornament in the singing style of Dinah Shore for use with this illustrative embodiment of the present invention. Note that this particular ornament has two humps in the trajectory, where the first $f_0$ peak coincides with the amplitude valley. The length of the ornament stretches elastically with the length of the musical note within a certain limit. On short notes (around 350 msec) the ornament advantageously stretches to cover the length of the note. On longer notes the ornament only affects the beginning. Dinah Shore often used this particular ornament in a phrase final descending note sequence, especially when the penultimate note is one note above the final note. She also used this ornament to emphasize rhyme words.

Figure 8:
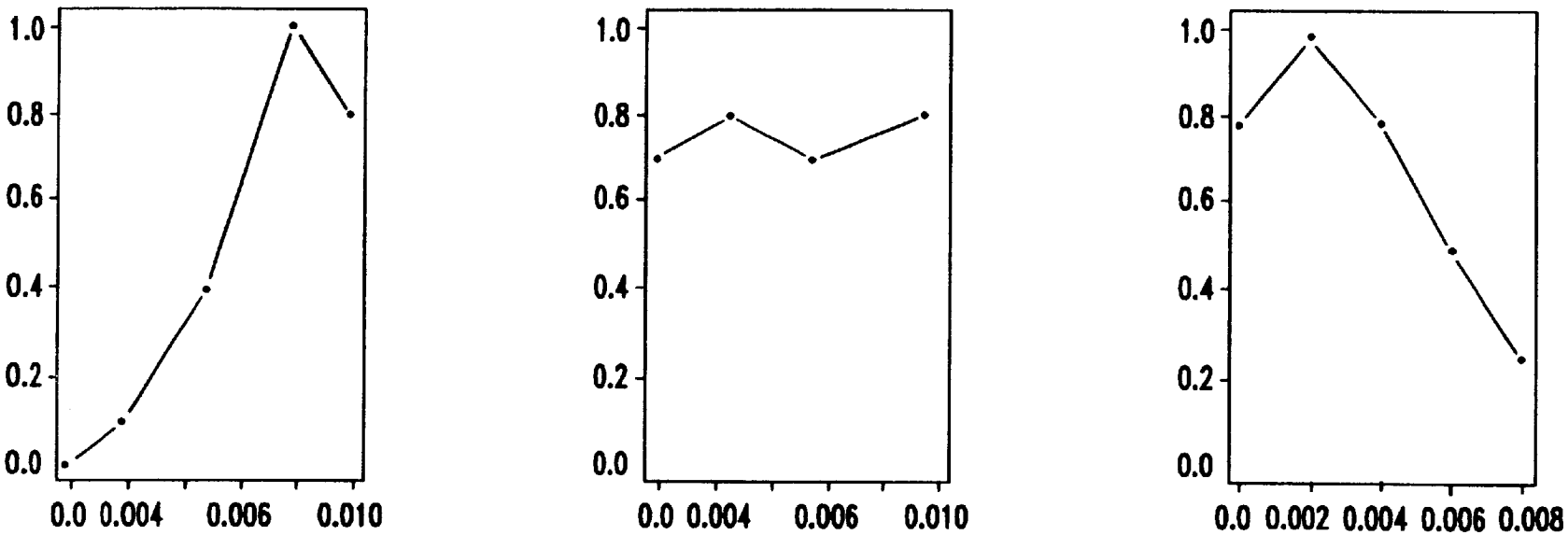
FIG. 8 displays three illustrative accent templates which may be used in accordance with one illustrative embodiment of the present invention to generate the phrase curve shown in FIG. 6.

In Dr. King's speech, there are also reproducible, speaker-specific accent templates. FIG. 8 displays three illustrative accent templates which may be used in accordance with one illustrative embodiment of the present invention to generate the phrase curve shown in FIG. 6. Dr. King's choice of accents is largely predictable from the phrasal position—a rising accent in the beginning of a phrase, a falling accent on emphasized words and in the end of the phrase, and a flat accent elsewhere.

In either case, in accordance with various illustrative embodiments of the present invention, once tags are generated, they are fed into the prosody evaluation module (e.g., prosody evaluation module 55 of FIG. 5), which interprets Stem-ML tags into the time series of $f_0$ or amplitude.

Illustrative Implementation Example

The output of the tag generation portion of the illustrative system of FIG. 5 is a set of tag templates. The following provides a truncated but operational example displaying tags that control the amplitude of the synthesized signal. Other prosodic parameters which may be used in the generation of the synthesized signal are similar, but are not shown in this example to save space.

The first two lines shown below consist of global settings that partially define the style we are simulating. The next section ("User-defined tags") is the database of tag templates for this particular style. After the initialization section, each line corresponds to a tag template. Lines beginning with the character "#" are commentary.

```
# Global settings
add=1; base=1; range=1; smooth=0.06; pdroop=0.2;
  adroop=1
# User-defined tags
name=SCOOP; shape=−0.1s0.7, 0s1, 0.5s0, 1s1.4,
  1.1s0.8
name=DROOP; shape=0s1. 0.5s0.2, 1s0;
name=ORNAMENT; shape=0.0s1, 0.12s−1, 0.15s0,
  0.23s1
# Amplitude accents over music notes
# Dai-
ACname=SCOOP; pos=0.15; strength=1.43; wscale=0.69
# sy
ACname=SCOOP; pos=0.84; strength=1.08; wscale=0.84
# Dai-
ACname=SCOOP; pos=1.68; strength=1.43; wscale=0.69
# sy
ACname=SCOOP; pos=2.37; strength=1.08; wscale=0.84
# give
ACname=DROOP; pos=3.21; strength=1.08; wscale=
  0.22
# me
ACname=DROOP; pos=3.43; strength=0.00; wscale=
  0.21
# your
ACname=DROOP; pos=3.64; strength=0.00; wscale=
  0.21
```

Figure 9:
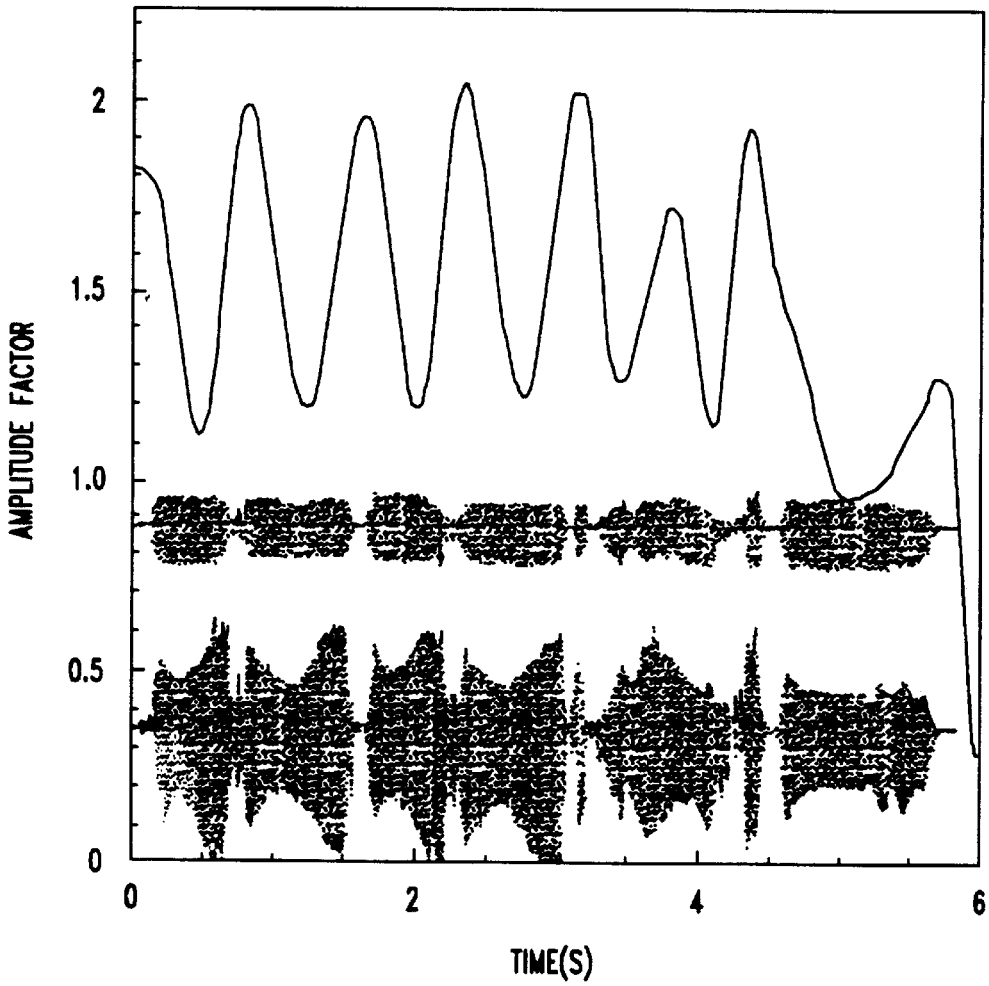
FIG. 9 displays an illustrative amplitude control time series, an illustrative speech signal produced by the synthesizer without amplitude control, and an illustrative speech signal produced by the synthesizer with amplitude control.

Finally, the prosody evaluation module produces a time series of amplitude vs. time. FIG. 9 displays (from top to bottom), an illustrative amplitude control time series, an illustrative speech signal produced by the synthesizer without amplitude control, and an illustrative speech signal produced by the synthesizer with amplitude control.

Illustrative Applications of the Present Invention

It will be obvious to those skilled in the art that a wide variety of useful applications may be realized by employing a speech synthesis system embodying the principles taught herein. By way of example, and in accordance with various illustrative embodiments of the present invention, such applications might include:

(1) reading speeches with a desirable rhetorical style;

(2) creating multiple voices for a given application; and (3) converting text-to-speech voices to act as different characters.

Note in particular that applications which convert text-to-speech voices to act as different characters may be useful for a number of practical purposes, including, for example:

(1) e-mail reading (such as, for example, reading text messages such as email in the "voice font" of the sender of the e-mail, or using different voices to serve different functions such as reading headers and/or included messages);

(2) news and web page reading (such as, for example, using different voices and styles to read headlines, news stories, and quotes, using different voices and styles to demarcate sections and layers of a web page, and using different voices and styles to convey messages that are typically displayed visually, including non-standard text such as math, subscripts, captions, bold face or italics);

(3) automated dialogue-based information services (such as, for example, using different voices to reflect different sources of information or different functions—for example, in an automatic call center, a different voice and style could be used when the caller is being switched to a different service);

(4) educational software and video games (such as, for example, giving each character in the software or game their own voice which can be customized to reflecting age and stylized personality);

(4) "branding" a service provider's service with a characteristic voice that's different from that of their competitors; and (5) automated singing and poetry reading.

Addendum to the Detailed Description

It should be noted that all of the preceding discussion merely illustrates the general principles of the invention. It will be appreciated that those skilled in the art will be able to devise various other arrangements which, although not explicitly described or shown herein, embody the principles of the invention and are included within its spirit and scope. Furthermore, all examples and conditional language recited herein are principally intended expressly to be only for pedagogical purposes to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future—i.e., any elements developed that perform the same function, regardless of structure.

Thus, for example, it will be appreciated by those skilled in the art that the block diagrams herein represent conceptual views of illustrative circuitry embodying the principles of the invention. Similarly, it will be appreciated that any flow charts, flow diagrams, state transition diagrams, pseudocode, and the like represent various processes which may be substantially represented in computer readable medium and so executed by a computer or processor, whether or not such computer or processor is explicitly shown. Thus, the blocks shown, for example, in such flowcharts may be understood as potentially representing physical elements, which may, for example, be expressed in the instant claims as means for specifying particular functions such as are described in the flowchart blocks. Moreover, such flowchart blocks may also be understood as representing physical signals or stored physical data, which may, for example, be comprised in such aforementioned computer readable medium such as disc or semiconductor storage devices.

The functions of the various elements shown in the figures, including functional blocks labeled as "processors" or "modules" may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, read-only memory (ROM) for storing software, random access memory (RAM), and non-volatile storage. Other hardware, conventional and/or custom, may also be included. Similarly, any switches shown in the figures are conceptual only. Their function may be carried out through the operation of program logic, through dedicated logic, through the interaction of program control and dedicated logic, or even manually, the particular technique being selectable by the implementer as more specifically understood from the context.

In the claims hereof any element expressed as a means for performing a specified function is intended to encompass any way of performing that function including, for example, (a) a combination of circuit elements which performs that function or (b) software in any form, including, therefore, firmware, microcode or the like, combined with appropriate circuitry for executing that software to perform the function. The invention as defined by such claims resides in the fact that the functionalities provided by the various recited means are combined and brought together in the manner which the claims call for. Applicant thus regards any means which can provide those functionalities as equivalent (within the meaning of that term as used in 35 U.S.C. 112, paragraph 6) to those explicitly shown and described herein.

We claim:

1. A method for synthesizing a voice signal based on a predetermined voice control information stream, the voice signal selectively synthesized to have a particular prosodic style, the method comprising the steps of:

analyzing said predetermined voice control information stream to identify one or more portions thereof for prosody control;

selecting one or more prosody control templates based on the particular prosodic style selected for said voice signal synthesis;

applying said one or more selected prosody control templates to said one or more identified portions of said predetermined voice control information stream, thereby generating a stylized voice control information stream; and synthesizing said voice signal based on said stylized voice control information stream so that said synthesized voice signal has said particular prosodic style, wherein said one or more prosody control templates comprise tag templates which are selected from a tag template database and wherein said step of applying said selected prosody control templates to said identified portions of said predetermined voice control information stream comprises the steps of:

expanding each of said tag templates into one or more tags;

converting said one or more tags into a time series of prosodic features; and generating said stylized voice control information stream based on said time series of prosodic features.

2. The method of claim 1 wherein said voice signal comprises a speech signal and wherein said predetermined voice control information stream comprises predetermined text.

3. The method of claim 1 wherein said voice signal comprises a speech signal and wherein said predetermined voice control information stream comprises predetermined annotated text.

4. The method of claim 1 wherein said voice signal comprises a singing voice signal and wherein said predetermined voice control information stream comprises a predetermined musical score.

5. The method of claim 1 wherein said particular prosodic style is representative of a specific person.

6. The method of claim 1 wherein said particular prosodic style is representative of a particular group of people.

7. The method of claim 1 wherein said step of analyzing said predetermined voice control information stream comprises parsing said predetermined voice control information stream and extracting one or more features therefrom.

8. The method of claim 1 further comprising the step of computing one or more phoneme durations, and wherein said step of synthesizing said voice signal is also based on said one or more phoneme durations.

9. An apparatus for synthesizing a voice signal based on a predetermined voice control information stream, the voice signal selectively synthesized to have a particular prosodic style, the apparatus comprising:

means for analyzing said predetermined voice control information stream to identify one or more portions thereof for prosody control;

means for selecting one or more prosody control templates based on the particular prosodic style selected for said voice signal synthesis;

means for applying said one or more selected prosody control templates to said one or more identified portions of said predetermined voice control information stream, thereby generating a stylized voice control information stream; and means for synthesizing said voice signal based on said stylized voice control information stream so that said synthesized voice signal has said particular prosodic style, wherein said one or more prosody control templates comprise tag templates which are selected from a tag template database and wherein said means for applying said selected prosody control templates to said identified portions of said predetermined voice control information stream comprises:

means for expanding each of said tag templates into one or more tags;

means for converting said one or more tags into a time series of prosodic features; and means for generating said stylized voice control information stream based on said time series of prosodic features.

10. The apparatus of claim 9 wherein said voice signal comprises a speech signal and wherein said predetermined voice control information stream comprises predetermined text.

11. The apparatus of claim 9 wherein said voice signal comprises a speech signal and wherein said predetermined voice control information stream comprises predetermined annotated text.

12. The apparatus of claim 9 wherein said voice signal comprises a singing voice signal and wherein said predetermined voice control information stream comprises a predetermined musical score.

13. The apparatus of claim 9 wherein said particular prosodic style is representative of a specific person.

14. The apparatus of claim 9 wherein said particular prosodic style is representative of a particular group of people.

15. The apparatus of claim 9 wherein said means for analyzing said predetermined voice control information stream comprises means for parsing said predetermined voice control information stream and means for extracting one or more features therefrom.

16. The apparatus of claim 9 further comprising means for computing one or more phoneme durations, and wherein said means for synthesizing said voice signal is also based on said one or more phoneme durations.

* * * * *